US005829837A

United States Patent [19]

Reiersen

[11] Patent Number: 5,829,837

[45] Date of Patent: Nov. 3, 1998

[54] PORTABLE STADIUM BACKREST

[76] Inventor: Ronald G. Reiersen, 11421 Logg Rd., NE., Bainbridge Island, Wash. 98110

[21] Appl. No.: 912,042

[22] Filed: Aug. 15, 1997

[51] Int. Cl.[6] ..... A47C 7/42; A47C 1/16

[52] U.S. Cl. ..... 297/352; 297/36; 297/252; 297/411.31

[58] Field of Search ..... 297/36, 114, 42, 297/43, 252, 411.31, 352

[56] References Cited

U.S. PATENT DOCUMENTS

| | | | |
|---|---|---|---|
| 116,934 | 7/1871 | Cutter . | |
| 168,401 | 10/1875 | Kruger, Jr. | 297/352 X |
| 219,234 | 9/1879 | Dormitzer | 297/352 X |
| 226,156 | 4/1880 | Blackler | 297/352 X |
| D. 248,601 | 7/1978 | Pierce et al. . | |
| D. 258,178 | 2/1981 | Bayne . | |
| 468,873 | 2/1892 | Hardendorf . | |
| 645,878 | 3/1900 | Tennyson . | |
| 816,545 | 3/1906 | Field . | |
| 1,184,531 | 5/1916 | Jackson . | |
| 1,293,778 | 2/1919 | Holm . | |
| 1,518,091 | 12/1924 | Mathis et al. | 297/352 X |
| 1,610,356 | 12/1926 | Byberg . | |
| 1,809,392 | 6/1931 | Ponten et al. . | |
| 2,254,684 | 9/1941 | Ivey . | |
| 2,448,924 | 9/1948 | Smith . | |
| 2,449,523 | 9/1948 | Wilson . | |
| 2,464,513 | 3/1949 | Johnson | 297/36 |
| 2,480,402 | 8/1949 | Elston . | |
| 2,571,282 | 10/1951 | Newton et al. . | |
| 2,710,646 | 6/1955 | Kirby . | |
| 2,725,925 | 12/1955 | Sanderson et al. . | |
| 2,797,740 | 7/1957 | Cappello . | |
| 4,068,889 | 1/1978 | Pierce et al. . | |
| 4,079,993 | 3/1978 | Pierce . | |
| 4,244,619 | 1/1981 | Yoshimura | 297/36 X |
| 5,516,193 | 5/1996 | Simpson . | |

*Primary Examiner*—Peter M. Cuomo
*Assistant Examiner*—David E. Allred
*Attorney, Agent, or Firm*—Charles A. Wilkinson; Harris A. Wolin

[57] ABSTRACT

A portable back and arm support device for use on a bleacher-type bench seat which incorporates a simple back support and two arm supports hingedly connected to the back support. Each arm support may be folded inward so that each arm support is in a parallel relationship with the back support as well as with each other in a tight, transportable arrangement, or each arm support may be folded outward in its operation position so that each arm support is in a somewhat perpendicular relationship with the back support. Each arm support contains a unique fulcruming arrangement which allows the arm supports to constrict, thereby attaching to, or "grasping" onto a bench-type seat by fastening to the mere edges of such bench-type seat.

12 Claims, 4 Drawing Sheets

54b
25b
94
25x
25
25y
25a
94
58a 54b
25x
25bb
25
25c
25y
25aa
25c
95
94x
58b 20
74b
74
70
78
74a
44
82
46b
38
42a
30
34
46a
42b
54a
54c
50
54
54d
62
25
25y
54b
94
25x
66b
66a
74
90
86
58a
58
66
58b

PORTABLE STADIUM BACKREST

BACKGROUND OF THE INVENTION

1. Field of the Invention

This invention relates generally to portable backrest devices which, when placed on a flat, bench-type seat, provide a user with additional back and arm support where none previously existed, and more particularly, to transportable backrest devices, especially for bleacher-type bench seats, including fastening means to "grip" the edges of the bench for a more secure connection.

2. Preliminary Discussion

Attending an event with group seating, whether a sporting, cultural, or an educational happening or function, usually involves sitting in one position for an extended period of time. The type of seating varies with the type of arena or event. A movie theater contains plush seating with back supports and arm supports, and sometimes even drink holders embedded within the arm supports. A little league stadium, on the other hand, usually contains rows of hard, wooden bleachers which merely provide a place to sit, without the luxury of back or arm supports.

Flat bleacher-type seats, without any back or arm rests, can be extremely uncomfortable, and can make viewing any event seem longer than it actually is. This also holds true for other flat-type seating arrangements, such as in a rowboat, a canoe, or on a conventional park bench. However, the practical nature of the seating is sometimes more important or significant to the provider of such seating than the total comfort of the user.

Two major disadvantages of bench-type seating are the hardness of the seat and the lack of support for the back and arms. The hardness of the seat is easily overcome by use of a pillow or a foam cushion pad. In fact, most sporting arenas sell foam cushions in anticipation of this condition, and it is not uncommon to find plain, flat cushions in the sporting section of any major department store. These pads are also often used by gardeners since gardeners often kneel for prolonged periods of time as they plant and work the soil.

The lack of a back and arm support, however, is not easily overcome with a common household object such as a pillow. The easiest thing to do would be to cut the legs off a conventional chair and place the remainder directly on the bench. This is, for obvious reasons, highly impractical, since no one is either willing to sacrifice a chair or tote such an awkward object around from place to place. In addition, placing this type of makeshift chair directly onto a bench would create a highly unstable situation, since an average bench is only between twelve and sixteen inches wide.

The next logical modification would be to take this impractical partial remainder of a chair and remove the bottom, while retaining the back and arm supports. This would result in a structure defined by two arm supports connected to each end of a back support, where the bottom surface of each arm support would be in contact with the bench to create a total chair effect. Of course, such a structure or construction would have to accommodate the dimensions of the bench, and would also have a lower configuration compatible with the upper configuration of the bench so the structure may be placed securely on the bench without any resultant forward or backward sliding movement.

The ideal embodiment would be a portable chair-like device, having armrests which fold inward to the backrest portion of the chair so that the chair-like device becomes manageable for easy and efficient transportation. Another preferred feature would be the ability to securely position the armrests on the bench so that the chair-like structure does not shift around with every movement of the user. Finally, once the chair-like device is positioned on the bench, it would be ideal to have the ability to secure such chair-like device to any conventionally-sized bench so that it could not be lifted or removed from the bench and the user could lean back without tipping free of the bench, in addition to not being able to slide around on the bench.

The stadium chair apparatus of the present invention embodies all of the above features in a combination unrepresented within the prior art. The prior art is replete with portable chairs or seats which nominally perform a similar supportive function. However, none of the prior art devices utilize the securing means conceived by the present inventor to secure such a chair-like device to a bench-type seat. The present inventor's securing means enables the fastening of his seat construction to benches of varying widths, and to benches where there is very little clearance between the overhang from the top of the bench and the bench's supporting legs located underneath.

DESCRIPTION OF RELATED ART

There are a large number of portable chair-like backrests designed to accommodate bench-type seating within the prior art. The evolution of such seating has been rather straightforward. Most of the innovations have concentrated on the inherent structure of the chair-like backrest, and not necessarily with respect to its mechanical operation. Basically, the overall design of the chair or backrest as a seating device has not changed a substantial amount since the inauguration of such device, and the inventive concentration in the development of improvements for such devices has focused largely on the connection between the portable chair or backrest and the bench top.

Most portable chair-like backrests are comprised of two elements. The first element, namely the actual back rest portion, is usually fairly straightforward in its construction. The back rest portion is frequently comprised of two vertical members with a span of material extending between the two vertical members in a taut arrangement to receive and support the weight of a user's back in the sitting or reclining position. The frame of the back rest formed by the two vertical members is usually connected to the second element, namely the seating part, or the bench engaging member or portion.

The bench engaging member is the element which has seen the most change since the creation of portable seats or backrests. Early portable seats or backrests failed to take advantage of the pre-existing mounting surface, i.e. the bench, and therefore part of the bench-engaging member consisted of an actual seat which was separate and apart from the bench. The bench engaging member therefore served as a supplemental seat in addition to an engaging member which fastened the entire apparatus to the bench.

Later portable back rest seating devices resembled a mere back rest, and took advantage of the supportive capacity of the surface of the bench. The bench engaging member of later apparatus was constructed in the form of side panels which "gripped" the edge of the bench using hook-like extensions from such side panels. These side panels served to stabilize and position the back rest member on the bench, and were able to fold inward toward the back rest member during transport. The side panels forming the bench-engaging members did not, however, constitute arm rests or arm supports, even though the back rest, in combination with the side panels, tended to enclose the person sitting within.

One of the earliest patents in this art or field, U.S. Pat. No. 116,934 issued to R. H. Cutter on Jul. 11, 1871, and entitled "Boat Chair", discloses a simple cushioned seat hinged on either side to a cushioned framework or bar-type backrest. The backrest folds down onto the cushioned seat to form a transportable chair. The cushioned seat fastens to the underside of the bench via two fastening screws extending from frame extensions which curl under the bench. This reference does not disclose any arm rests or means to fasten the chair to the backside of the bench.

U.S. Pat. No. 468,873 issued to E. Hardendorf on Feb. 16, 1892, entitled "Adjustable Folding Boat Seat", discloses a similar device to that of Cutter's "Boat Chair", with the addition of increased padding on the back support and a more convenient transportable structure. It contains an elongated frame extension, more so than that of Cutter's device, which frame extension curls underneath the bench to provide support for the portable seat. Hardendorf's boat seat does not provide for arm supports.

U.S. Pat. No. 816,545 issued to B. L. Field on Mar. 27, 1906, entitled "Seat Back", discloses a portable seat back which adjustably engages both the front and the back of a bench-type seat resulting in a fastenable arrangement upon the bench-type seat. The front engagement means is in the form of a downwardly turned loop which acts to embrace or engage the front of the bench. The actual seat back member terminates in an angled extension such that when the seat back member is rotated from its transportable position, i.e. aligned with the bench engaging member, to its seating position, i.e. substantially perpendicular to the bench engaging member in preparation to be used as a back rest, the angled extension grasps the back edge of the bench to secure the entire apparatus onto the bench. There is also provided an adjusting means so that the bench engaging member can accommodate benches of varying widths. However, as with the previous references, the Field "Seat Back" does not provide for arm supports.

Over the next ten or so years, the connection between the actual seat back and the bench engaging member evolved from a rigid slotted hinging link, as seen in both U.S. Pat. No. 1,184,531 issued to O. M. Jackson on May 23, 1916 entitled "Folding Chair" and U.S. Pat. No. 1,293,778 issued to A. M. Holm on Feb. 11, 1919 entitled "Foldable Seat for Benches", to a more flexible member as seen in U.S. Pat. No. 1,610,356 issued to J. J. Byberg on Dec. 14, 1926 entitled "Back Rest for Bleacher Seats." Byberg's back rest utilizes a single piece of cord which provides the integrity for the framework of the chair. One of the most recent references, U.S. Pat. No. 5,516,193 issued to B. K. Simpson on May 14, 1996 entitled "Portable Stadium Seat Apparatus", utilizes flexible straps with adjustment buckles connected to a primarily fabric construction, where the adjustment buckles allow the user to vary the angle between the bench and the back rest. Simpson connects the portable seat to the bench in the same manner as many of the aforementioned portable seats by using a hook arrangement at the front of the bench engaging member along with a positioning member at the back of the bench engaging member.

U.S. Pat. No. 2,448,924 issued to W. R. Smith on Sep. 7, 1996, entitled "Bed Rest", discloses a portable back rest with adjustable arm rests for use by a bed-ridden patient. The arm rests may be forwardly arranged with respect to the backrest so that the apparatus resembles a chair with arm supports, or rearwardly arranged behind the backrest portion so that the apparatus functions as a mere backrest with the rearwardly arranged arm rests providing freestanding support for the backrest from behind. The notched arm rests allow the arm rests themselves to assume a variety of positions and serve a variety of functions with respect to the actual back rest.

U.S. Pat. No. 2,571,282 issued to F. P. Newton et al. on Oct. 16, 1951, entitled "Sport Seat", discloses a portable chair without arm supports which fastens to a bench-type seat via adjustably spaced wire hooks having inturned coaxial ends. The positioning of the wire hooks varies the positioning of the seat along the transverse axis of the bench enabling the seat to accommodate benches of varying widths. The seat and back sections of the device fold into each other forming a transportable unit. Newton's device does not contain any arm support, nor does it have the ability to fasten onto, or grip, a bench-type seating surface. U.S. Pat. No. 2,725,925 issued to J. R. Sanderson et al. on Dec. 6, 1955, entitled "Folding Seat Devices", discloses a similar apparatus wherein the back section folds downwardly onto the seat section. However, the Sanderson device discloses arm supports without disclosing a seat support which is separate and apart from the bench-type seat onto which the device is placed. Sanderson's device will only work if the clearance under the seat is substantial enough to accommodate the elongated supporting tongue, i.e. if the vertical support for the bench is located toward the middle of the bench and not toward the edges of the bench resembling more of a box layout versus a table layout.

The next twenty-five years of innovation produced a portable stadium seat with very little change in the overall design and functionality. The main difference between the next generation of stadium seats and the previously mentioned seats is the fastening means. Previous designs comprised hooks or tongues which extended underneath the bench, such hooks or tongues were usually connected to the seating portion of the portable apparatus and thus required a substantial amount of clearance underneath the bench with which to grasp the bench. Newer designs incorporate arm members which extend from the back rest portion along the width of the bench-type seat, and comprise hooking members which fasten to the front and rear edges of the seat.

U.S. Pat. No. 2,710,646 issued to J. B. Kirby on Jun. 14, 1955, entitled "Portable Seat-Back", discloses a single-piece lightweight construction comprising a backrest portion with two side panels hingedly connected thereto, where the hinging is comprised of a canvas webbing. The side panels fold inwardly toward the backrest to form a transportable unit, and the canvas web-type hinges provides for easy folding and unfolding. The fastening hooks are riveted to only the front edges of the side panels and there is no fastening means located at the rear of Kirby's seat. Kirby's side panels do not operate as arm rests, but merely serve to stabilize and fasten the back rest to the bench-type seating surface. U.S. Pat. No. 2,797,740 issued to A. Cappello on Jul. 2, 1957, entitled "Portable Seat", discloses a cardboard-type version of Kirby's apparatus, with the addition of a cup holder.

James E. Pierce's U.S. Pat. No. 4,079,993 issued on Mar. 21, 1978 entitled "Back Rest" and U.S. Pat. No. 4,068,889 issued on Jan. 17, 1978, entitled "Portable Back Rest", disclose a portable backrest with functional characteristics quite similar to that of Kirby's device, but with different fastening means and different side panel hinges. Pierce's '889 patent discloses fastening hooks at the front and rear of the device, which is an improvement over the Kirby design.

The overall concept and construction of the Pierce apparatus, however, remains the same as Kirby's.

Pierce and Kirby both exhibit a back rest with permanently hinged side panels, and fastening hook-like means emanating from the ends of the side panels which extend around the edge of the bench-type seat to which the device is fastened. Pierce's back rest has additional fastening means which extend around the back of the bench. Both Pierce and Kirby, however, are constrained by the respective length of their non-adjustable side panels, and therefore, are not as amenable to bench-type seats of varying widths as could be desired.

The prior art fails to disclose a portable backrest for use on a bench-type seat, which also provides comfortable support for the arms, which also folds into an easily transportable arrangement, and which has the ability to adjustably fasten to the front and rear of a bench-type seat. Most of the hook-type fasteners of the prior art would fail to securely fasten to a bench-type seat which closely resembles a box in cross section, i.e. where the vertical supports underneath the bench-type seat are closely situated, or positioned, near the edges of the bench. Most prior art devices would merely lay on the bench-type seat, as opposed to fastening thereto, in situations where there is very little clearance underneath the front or rear sections of the bench-type seat to accommodate elongated fastening hooks or tongues.

There is a need, therefore, for a portable seating device that can simultaneously support both the back and the arms providing an overall comfortable arrangement, and which can accommodate a variety of seat widths and fasten thereto without regard to the amount of clearance underneath the seat. The device of the present invention embodies a unique fastening means incorporated within extensions of or as part of the arm rests, or short legs, of the invention which allows the seat to fastenably "lock" onto the mere edges of a bench-type seat without sacrificing secure affixation, and does not use fastening hooks or tongues which require a substantial amount of clearance underneath the bench in order to fasten to such bench. The device of the present invention also makes use of a unique hinging arrangement allowing the arm rests to swing freely between a closed, transportable position and an open, operating position.

OBJECTS OF THE INVENTION

It is an object of the present invention, therefore, to provide a portable seating device which will simultaneously support a person's back and arms where no previous back or arm support existed, such as on a bench-type seat.

It is a further object of the present invention to provide a device which converts from an easily transportable, relatively confined, compact form or configuration to an effectively sturdy, operating form or configuration.

It is a still further object of the present invention to provide a portable seating device which can fasten to a bench-type seating surface and affix thereto by clamping onto only the edges of the top of the bench-type seating surface.

It is a still further object of the present invention to provide a portable seating device that contains extensions on the arm supports which serve as a fixation means by which to fasten the portable backrest device of the invention to a bench-type seat.

It is a further object of the present invention to provide a portable seating device that comprises a fixation means which, when the device of the invention is fastened to a bench-type seat, is assisted by the natural position of a person's body upon the device of the invention, whereby a person leaning back upon and placing weight upon the arm rests of the device of the invention will increase the fixation or clamping between the device of the invention and the bench-type seat.

It is a still further object of the present invention to provide a portable seating device comprising arm supports with a unique fulcrum arrangement which enables extensions on such arm supports to fasten to very abbreviated portions, or in many cases the mere edges of the top of a bench-type seat.

It is a still further object of the present invention to provide a portable seating device which utilizes an improved hinge arrangement which allows the arm supports to fold inward toward the back support, the entire device of the invention assuming an easily transportable structure.

It is a still further object of the present invention to provide a portable seating device which will transform an uncomfortable bench-type seat which normally has no back or arm supports, into a seat which does have both back and arm supports.

It is a still further object of the present invention to provide a portable seating device which transforms an uncomfortable seating arrangement into a reasonably comfortable place to sit and relax for an extended period of time.

It is a still further object of the present invention to provide a portable seating device which is superior in quality and overall design, utilizes strong materials which do not sacrifice sturdiness, dependability or comfort, and which does not mar or damage the bench-type seat when fastened thereto.

It is a still further object of the present invention to provide a portable seating device which is easy to manufacture, effortless to transport, and requires no tools to operate.

Still other objects and advantages of the invention will become clear upon review of the following detailed description in conjunction with the appended drawings.

SUMMARY OF THE INVENTION

The portable seating device of the present invention is constructed of three major parts, (a) a backrest support plus (b) two leveraged arm rests arranged and constructed such that the supports for the arm rests can be forcefully leveraged toward each other to clamp lower extensions of such arms about the edges of the horizontal edge portions of a stadium seat.

More particularly, the portable seating device of the present invention consists of three distinct elements, namely a back rest and two arm supports with included seat grasping arm extensions or legs. The back rest consists of a slightly curved back receiving member which accommodates the contours of a human back, and also preferably incorporates a handle, frequently in the form of a hollowed-out portion or cut-out portion of the back, for use when carrying the apparatus of the invention. The back rest is supported by a pair of transverse bracing members, or ribs, which extend from one arm support to the other, and are fastener connected to the back receiving member.

Each arm support is comprised of four distinct elements, namely a rear leg, or gripping member, situated along the same general plane as the backrest which secures the apparatus of the invention to the rearward edge of a bench-type seat, a front leg, or gripping member, which secures the apparatus of the invention to the front edge of a bench-type seat, an arm-receiving member which connects the rear leg of the arm support to the front leg of the back support, and support plate which is fastener connected to the front leg of the arm support and is pivotally connected to the rear leg of the arm support. Each arm support is connected to the bracing members or ribs of the back rest by way of a pair of "U" shaped bolts serving as adjustable hinges. The bolts or hinge bolts allow the arm supports to rotate from a closed, transportable position to an open, fastening or use position without modifying the physical characteristics of the arm supports. The "U" shape of the hinge bolts allows the arm supports to rotate around the bolt's connection to the back supports, the bolt being fastened to the arm support at each leg of the bolt, i.e. the ends of the "U", and extending through the bracing member or rib of the back support at the bolt's center point, i.e. the bottom of the "U." One pair of bolts, associated with either one of the arm supports, has an extended "U" shape, i.e. the legs of the "U" are longer than the legs of the other "U" bolt, so that one arm support, when folded inward toward the back support for transport, is closer to the back support plate than the other arm support when such other arm support is subsequently folded inward, thereby resulting in both arm supports assuming a somewhat parallel configuration with respect to each other and with respect to the back support at the same time.

Each arm support contains a fastening or locking means comprised of a sliding arm receiving member which incorporates a fulcrum for the fastening of the apparatus onto a bench-type seat. The rear portion of the arm receiving member of each of the arm supports is equipped with a slide opening or yoke to slide on or over the rear leg of the arm support from an upper, released or unfastening position to a lower, fastening position. The front portion of the arm receiving member of the arm support is pivotally connected to the front leg of the arm support, and the front leg of the arm support pivots between an unfastened position when the arm receiving member is in its upper position, and a fastened position when the arm receiving member is in its lower position. The support plate extending between the rear and front legs of the arm support also pivots in response to the fulcruming movement of the front leg. The lower portion of each leg of the arm support contains a carved out, concave niche which receives the edges of a bench-type seat, or more appropriately designated the "bullnose," when the apparatus is fastened thereto. In other embodiments, the lower ends of the legs are cut out or profiled to clamp onto an expanded fabricated sheet metal bench-type seat having an expanded upper configuration.

The apparatus of the present invention is designed for convenient and easy transport, and is durable in construction and overall operation. The arm support members of the present invention lend additional comfort to a situation which previous inventors have neglected to provide for, and are equipped with a unique fastening mechanism which allows the device of the present invention to be fastened to the edges of almost any sized bench-type seat irrespective of any impediments located underneath which would prevent fastening from below.

DESCRIPTION OF THE PREFERRED EMBODIMENTS

Figures 1, 1A, 1B:
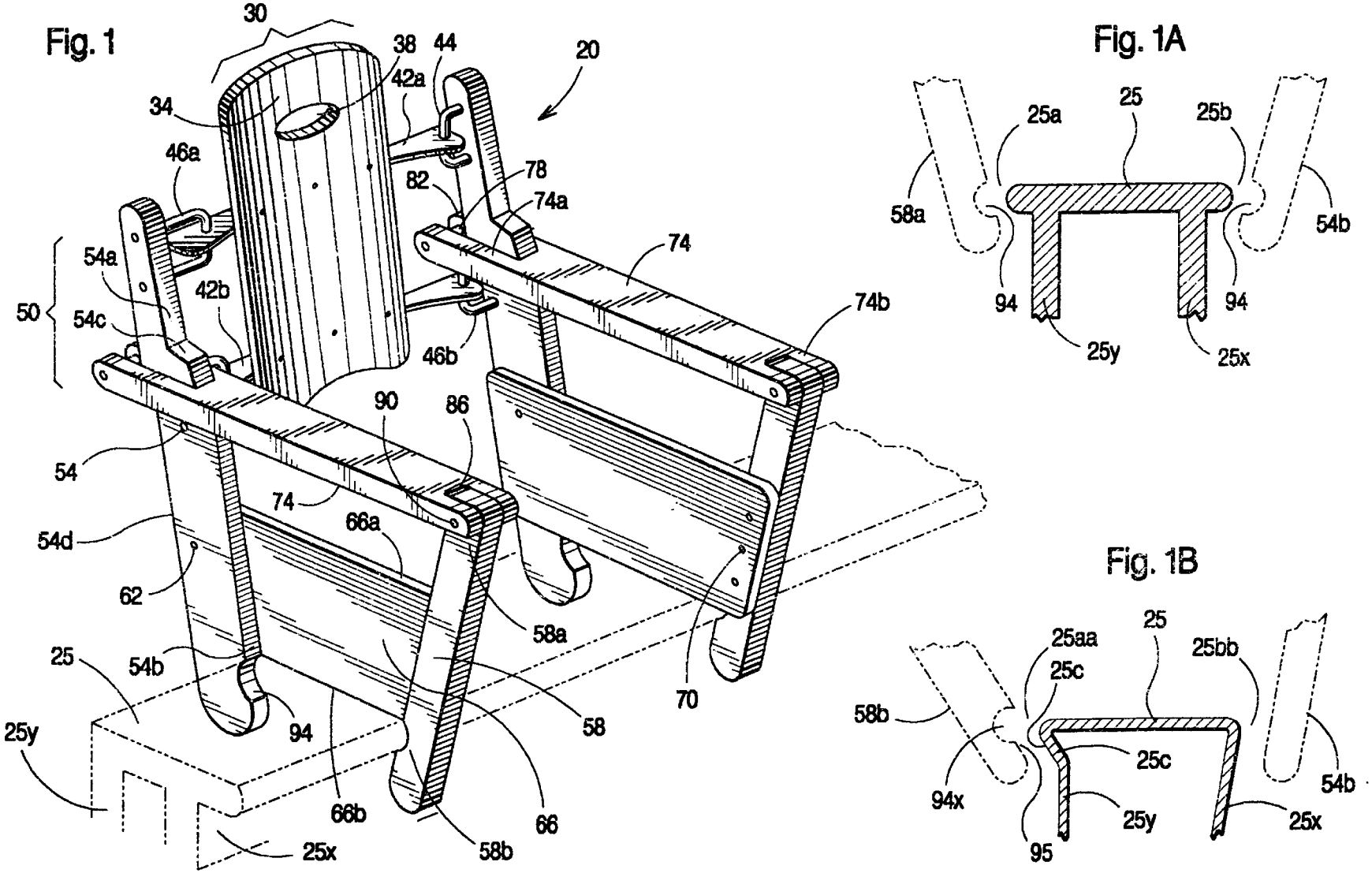
FIG. 1 is an isometric view of the device of the invention shown in an operating, fastened position.

The device of the present invention is superior in design and construction to previously patented portable seat devices in a variety of aspects. The most recent devices are dedicated to practical support and are composed of lightweight materials. Unfortunately, while these devices may be deemed to serve their purpose, that is, to contribute a back rest to a place where none previously existed, most have been rather insecure and subject to possible displacement during use or attachment to bench-type seats having constricted clearance below such seats. None of the more recent devices, furthermore, pay particular attention to the other major aspect of bench-type seating which makes it uncomfortable, i.e. the lack of arm support.

The device of the present invention incorporates arm supports which serve dual functions, each of equal importance. The first function is, of course, as the name suggests, that of supporting a person's arms while such person is enjoying the use of the device of the invention. The second function is directed to the fastening of the device upon a bench-type seat, where the two legs of each of the arm supports, in essence, "grip" the edges, or the "bullnose," of the bench-type seat to secure the entire device to the bench-type seat.

The prior art is replete with portable seats or backrests which merely hook onto the edges of a bench, without accommodating the fact that benches may have different widths and construction impediments which make under-the-bench fastening almost impossible. The present inventor has recognized that mere hook-type fasteners which restrain the portable seat or backrest from moving across the bench-type seat in the transverse direction are deficient in many respects. First of all, these hook-type fasteners are often non-adjustable and therefore do not accommodate a variety of adjustments within a specific bench-type seat width. If the bench were wider than the fasteners could accommodate, then the seating device would merely lay upon the surface of the bench-type seat. If the bench were narrower than the span of the fasteners, then the seating device would rest loosely upon the bench-type seat, and any shifting done by the person using the seating device would be directly transferred to the seating device resulting in an unstable environment.

Prior art hook-type fasteners, or fastening means used with portable seats or backrests, are usually elongated, extend underneath the bench-type seat, and anchor the portable seating device from below. It is often the case that the luxury of accessible space through which to anchor a portable seat or backrest to a bench from underneath is nonexistent. This occurs when the bench-type seat assumes a configuration more akin to an enclosed box, where the top edges of the bench extend slightly over the supporting members and there is no access underneath the bench. Early prior art seating or backrest devices incorporated hook members which extended a fair distance underneath the bench, since the bench assumed a configuration more akin to a kitchen table, where the supporting member was centered underneath the bench and there was free space between the edge of the bench and the supporting member through which to extend a fastening hook or tongue.

The bench engaging member of the device of the present invention is an improvement over those earlier devices and exemplifies the latest innovation in portable seat back rests, including the fact that it incorporates actual arm rests and not merely a pair of device-supporting side panels. The bench engaging arrangement of the present invention serves not only to stabilize the entire apparatus upon the bench, but also fastens to the bench using a fulcrum arrangement undisclosed within the prior art seating devices. The actual part of the arm support member of the device of the invention, upon which a person would lay their arm, pivots in such a manner as to constrict and release (or fasten and release) the apparatus of the invention to and from the edges, or "bullnose," of the bench. This type of arrangement is far superior to the mere flexible hook-type fasteners of even the most recent prior art seating devices, and provides a considerable improvement in the field of portable seat/back rest apparatus.

The present inventor is cognizant of the different supporting structures used for bench-type seating, and an integral aspect of the present invention is its ability to fasten to bench-type seats which have minimal clearance or overhang between the edge of the seat and the supporting structure underneath the seat. The present inventor has, in other words, recognized that bench-type seating does not always afford the luxury of anchoring space from underneath the bench. The present inventor has also realized that benches come in a variety of different widths. However, the present inventor has also recognized that the wood bleacher industry is surprisingly consistent in using 9¼ inch wide by ¾ inch thick benches (fashioned from a nominal 1" by 10" piece of lumber), and has designed the device of the present invention to accommodate these characteristic dimensions. The present inventor has, therefore, designed a fastening mechanism which encloses around the edges of a bench-type seat to fasten a seat back device thereto, and can, therefore, accommodate a variety of bench-type seat widths without being hindered by the lack of space underneath a non-conventional bench-type seat. The fastening mechanism is integral to the arm support, and distinguishes the device of the present invention from all of the other prior art devices of this nature.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

FIG. 1 is an isometric, diagrammatic view of the portable seating device 20 of the present invention shown resting on a bench 25, said bench being illustrated in phantom. The seating device of the invention 20 comprises two arm supports, designated broadly by the reference numeral 50, each connected to a back support or backrest, designated broadly by the reference numeral 30. The backrest 30 comprises a curved board or back receiving member or plate 34 preferably incorporating a cut-out portion 38 to serve as a handle for grasping during transport of the device 20 to and from a particular event location. The cut-out portion 38 may also be used for hanging the device of the invention 20 from a hook or similar supporting means. Two bracing members or ribs 42*a* and 42*b* are fastener connected to the rear of the back receiving member or plate 34, and form the connection between the back rest 30 and the two arm supports 50. Each bracing member or rib 42*a,b* has a curved outer edge 44 which accommodates or facilitates the swinging motion of the arm supports 50 from a closed, transportable position to an open, operating or seating position.

The bracing members or ribs 42*a,b* preferably elevate or mount the back receiving member or plate 34 approximately six to twelve inches from the top surface of the bench-type seat 25 when the device of the invention 20 is attached to such bench-type seat. The gap provided by the space between the top surface of the bench-type seat 25 and the elevated back receiving member or plate 34 serves at least two important functions. First, the gap allows a person to extend their rear section or posterior behind the plane of the back receiving member 34, to either accommodate their particular physical characteristics, or to push or move back their center of gravity within the confines of the devices of the invention. The present inventor has found that if the elevation of the back receiving member or plate 34 is spaced only two to four inches from the top surface of the bench-type seat, the back receiving member would provide additional lumbar support for some people, but would, on the other hand, interfere with the coccyx, or tailbone, of other people.

Figure 2:
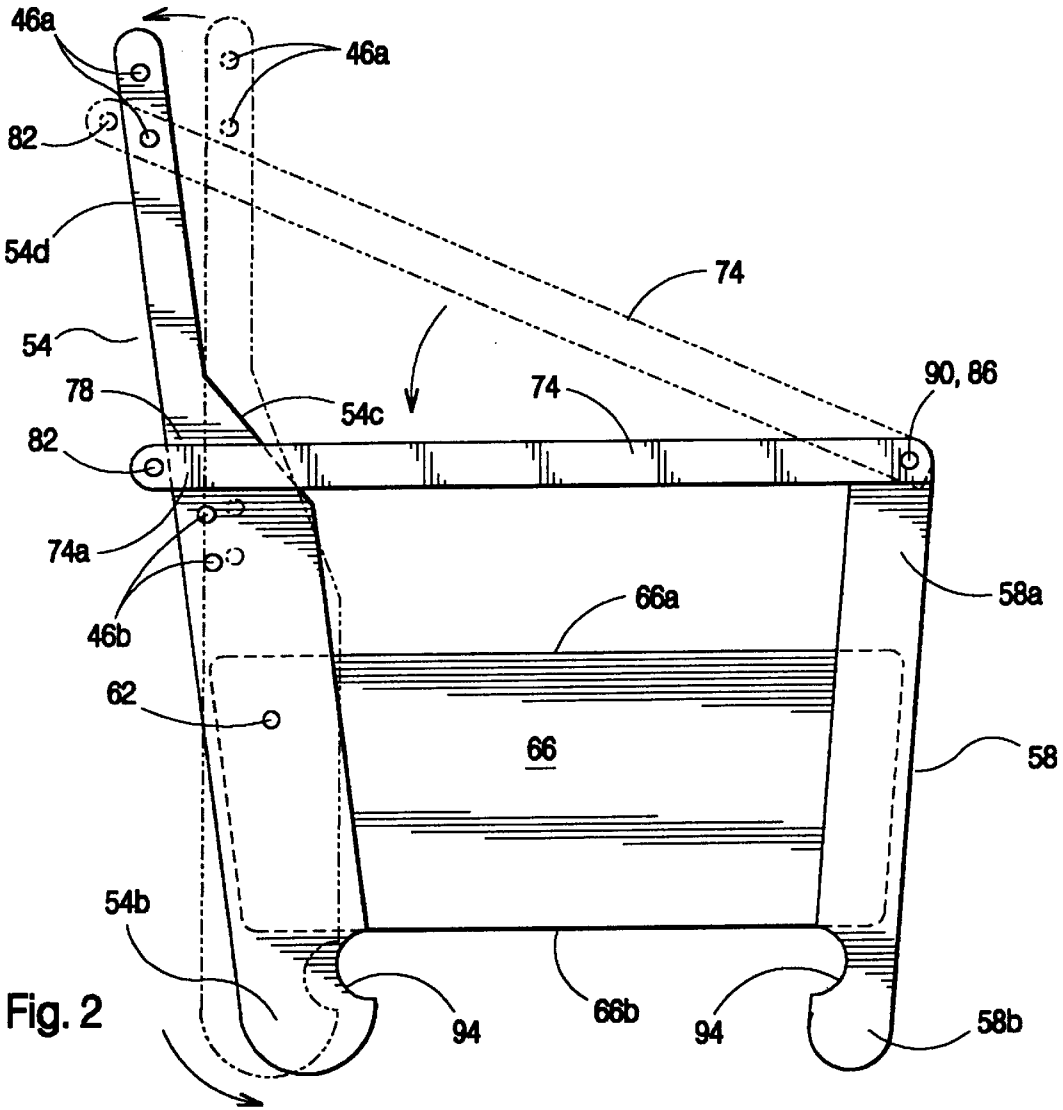
FIG. 2 is a side view of the device of the invention showing movement of the arm supports of the invention from an unfastened position or configuration to an unfastened position or configuration.

Each arm support 50 is comprised of four distinct elements, namely:

1) a rear leg or gripping member 54 situated along the same plane as the back rest 30 comprised of an upper, biasing portion 54*a,* a lower, grasping portion 54*b* incorporating curved bench edge engaging surfaces 94, a middle, wedge portion 54*c,* and a rear contact surface 54*d* along the biasing and wedge portions better defined in FIG. 2,
2) a front leg or gripping member 58 which secures the apparatus 20 of the invention to the front edge of a bench-type seat 25 comprised of an upper section 58*a* incorporating a pivot pin 90, and a lower grasping section 58*b* also incorporating curved bench edge engaging surfaces 94,
3) an arm-receiving member 74 which connects the rear leg or gripping member 54 of the arm support 50 to the front leg or gripping member 58 of the arm support 50 comprising a sliding rear section 74*a* with a notched orifice 78 closed by a clevis pin assembly 82 and forming a closed yoke or guide for the upper portion of the leg or gripping member 54, the notched orifice 78 and clevis pin assembly 82 being dimensioned to accommodate and slide about and along the upper biasing section or portion 54*a* and the middle wedge section or portion 54*c* of the rear leg 54, and a pivoting front section or portion 74*b* incorporating a notch 86 and pivot pin 90 assembly, the pivot pin 90 assembly joining the pivoting front section 74*b* and the upper pivoting section 58*a* of the front leg 58, and
4) a support plate 66 which is fastener connected to the front leg 58 of the arm support 50 by way of fastening screws 70, and pivotally connected to the rear leg 54 of the arm support 50 by way of a pivot connection 62, and comprises an upper section 66*a* and a lower bench surface engaging section 66*b*.

Each arm support 50 is connected to the bracing members 42*a,b* of the back rest 30 by way of a pair of "U" shaped connecting members 46*a* and 46*b* conveniently taking the form of "U" shaped bolts upon which the ribs or bracing members 42*a* and 42*b* are pivoted. The movement of the arm rests 50 about or with respect to the back rest 30 accommodated by the "U" shaped connecting members or bolts 46*a,b* will be more particularly illustrated and described in FIGS. 3 and 3A. One pair of bolts 46*a,b* in the case shown, those connected to the nearest rear leg on the left of the illustration in FIG. 1, is longer than the other pair to accommodate folding of one arm support 50 over the other arm support 50 in the closed position, which folding will be more particularly illustrated and described in FIGS. 3C and 3D. The bench 25 shown in phantom in FIG. 1 is comprised of a main seat section 25 plus two enclosures 25*x* and 25*y* which block off the underside of the main seat section 25. It will be understood, however, that these two sections 25*x* and 25*y* might well not be present in many installations.

FIGS. 1A and 1B illustrate profiles of two potential bench-type fastening arrangements. FIG. 1A shows the profile of a bench-type seat with "bullnose" type edges, generally indicative of wooden-type benches, while FIG. 1B shows a profile of a bench-type seat with sharper, more slanted edges generally indicative of sheet metal-type benches. In FIG. 1A, the lower edges of the legs of the invention 54*b* and 58*b* shown in phantom have curved bench edge engaging members 94 which grasp the edges 25*a* and 25*b* of the bench 25 when the legs 54*b* and 58*b* are brought together in a fastenable, operating arrangement. The lower leg contour embodiments illustrated in FIG. 1A are preferable for benches which have "bullnose" type edges 25*a* and 25*b*. In FIG. 1B, however, the rear edge 25*bb* and the front edge 25*aa* of the bench 25 are slanted downwardly, resulting in two potential lower leg embodiments for fastening thereto. The rear lower leg embodiment 54*b* of FIG. 1B shows the absence of a curved bench edge engaging member present in FIG. 1A, while the front lower leg embodiment 58*b* of FIG. 1B shows a modified curved bench edge contoured engaging member 94*x* to accommodate the front edge 25*aa* of the bench 25 of FIG. 1B. The modified curved bench edge engaging member 94*x* is curved at its upper section to receive the front edge 25*aa* of the bench 25, while the lower section 95 of the modified bench edge engaging member 94*x* of FIG. 1B is flattened to receive the flat edge 25*c* of the front edge 25*aa* of the bench 25. The modified bench edge engaging member 94*x* of the lower front leg 58*b*, with its flattened end surface 95 could be deemed a universal configuration, since it can accommodate both a "bullnose" edge, as seen in FIG. 1A, and an edge with a following slant, as seen in FIG. 1B, where the curved section of the bench edge engaging member 94*x* receives the edge of the bench 25*aa* and the flat section 95 receives the flat bench edge 25*c* as shown. It will be understood, and it will be evident to one skilled in the art, that the lower front and rear leg configurations 54*b* and 58*b* could assume any combination of bench edge engaging surfaces. Both front and rear lower leg configurations could assume a straight profile illustrated by the lower rear leg 54*b* of FIG. 1B, or both could assume the universal profile illustrated by the front rear leg 58*b* of FIG. 1B, or each leg could be different from each other, mostly depending on the type of bench configuration. For purposes of illustration and explanation, however, the lower leg configurations of FIG. 1A will be used to discuss the remaining aspects and attributes of the invention. The lower portions of the bench edge engaging sections can be made adaptable to different bench edges by providing removable or changeable inserts with different profiles, which inserts can be attached to prepared insert sections on the leg sections 54 and 58.

FIG. 2 is a side view of one of the arm supports 50, illustrating the two pivot assemblies integral to the structure of the arm support 50 which facilitates operation of the device of the invention. Movement of the rear section 74*a* of the arm receiving member 74 along the upper biasing section 54*a* and middle wedge section 54*c* of the rear leg 54 of the arm support 50, where such movement of the rear section 74*a* occurs by way of the notched section 78 sliding along the upper section 54*a*, wedging upon the middle wedge section 54*c*, and restrained by the clevis pin 82, causes the arm receiving member 74 to pivot either the front leg 58 or the rear leg 54 of the arm support 50 depending on which leg is placed onto or biased against the bench-type seat first. The pivot pin 90, which joins the pivoting front section 74*b* of the arm receiving member 74 to the upper pivoting section 58*a* of the front leg 58, defines a fulcrum arrangement between the arm receiving member 74 and the front leg 58, such that upward movement of the sliding rear section 74*a* with concomitant movement of the clevis pin 82 along the upper rear surface 54*d* of section 54*a* of rear leg 54 translates into an outward, releasing movement of the rear leg 54, and downward movement of the sliding rear section 74*a* translates into an inward, fastening movement of the rear leg 54 upon the wedging of the sliding rear section 74*a* upon the middle wedge section 54*c*. The pivot pin 62, which joins the support plate 66 to the lower grasping section 54*b* of the rear leg 54, allows the rear leg 54 to pivot in response to the movement of the arm receiving member 74 along the upper section 58*a* of the rear leg 54 as such leg pivots about pin 90. On the other hand, the pivoting arrangement and/or movement can be restated such that front leg 58, and not the rear leg 54, moves in response to the movement of the arm receiving member 74. In this instance, the pivot pin 90, which joins the pivoting front section 74*b* of the arm receiving member 74 to the upper pivoting section 58*a* of the front leg 58, also defines a fulcrum arrangement between the arm receiving member 74 and the front leg 58, such that upward movement of the sliding rear section 74*a* along the upper biasing section 54*a* and middle wedging section 54*c* with the clevis pin contacting the rear surface 54*d* of rear leg 54, and if the rear leg 54 is held against the back edge of the bench-type seat, translates into an outward, releasing movement of the front leg 58 with a simultaneous lifting of the front end of the plate 66, and downward movement of the sliding rear section 74*a* translates into an inward, fastening movement of the front leg 58 and a simultaneous downward movement of the plate 66 upon the wedging of the sliding rear section 74*a* upon the middle wedge section 54*c*. Thus the pivot pin 62, which joins the support plate 66 to the lower grasping section 54*b* of the rear leg 54, allows the support plate 66 to pivot in response to the backward movement of the upper biasing portion 54*a* of the rear leg 54. The difference in movement between the rear leg 54 or the front leg 58, in response to the movement of the arm receiving member 74, depends upon which leg is used to anchor the device of the invention 20 during the releasing and fastening stage, and whether the lower edge of the plate 66 is placed immediately in contact with, or parallel to, the top of the bench-type seat 25. If the rear leg 54 is first placed onto the rear edge of the bench-type seat, so that the curved bench edge engaging surface 94 of the rear leg 54 comes in contact with the rear edge of the bench-type seat, then the cam movement of the arm receiving member 74 will cause the front leg 58 to move inward toward the bench-type seat, and the plate 66, if it is not already in contact with the top of the bench, to move downwardly into contact therewith. However, if the front leg 58 is first placed onto the front edge of the bench-type seat, so that the curved bench edge engaging surface 94 of the front leg 58 comes in contact with the front edge of the bench-type seat, then the cam movement of the arm receiving member 74 will cause the rear leg 54 to move inward toward the bench-type seat. Either operable arrangement will work, i.e. will fasten and unfasten the device of the invention 20 to a bench-type seat, however, the latter arrangement, i.e. initially anchoring the device of the invention using the front leg 58 and preferably contacting the top of the bench-type seat 25 with the underside 66*b* of the plate 66 resulting in the fastening and unfastening movement of the rear leg 54, is the preferable mode of operation. Anchoring the device of the invention using the front leg 58 is functionally advantageous, since the pivot connection 62 and the cam action resulting from the sliding of the rear section 74*a* of the arm receiving member 74 along the upper section 54*a* and wedging upon the middle wedging section 54*c* of the rear leg 54 both occur along the same plane as the rear leg 54. Therefore, there is a direct translation between the movement of the arm receiving member 74 and the resultant movement of the rear leg 54, especially since the arm receiving member 74 places a direct force upon the rear leg 54 as the arm receiving member 74 wedges upon the middle wedge section 54*c* of the rear leg 54.

Figure 5:
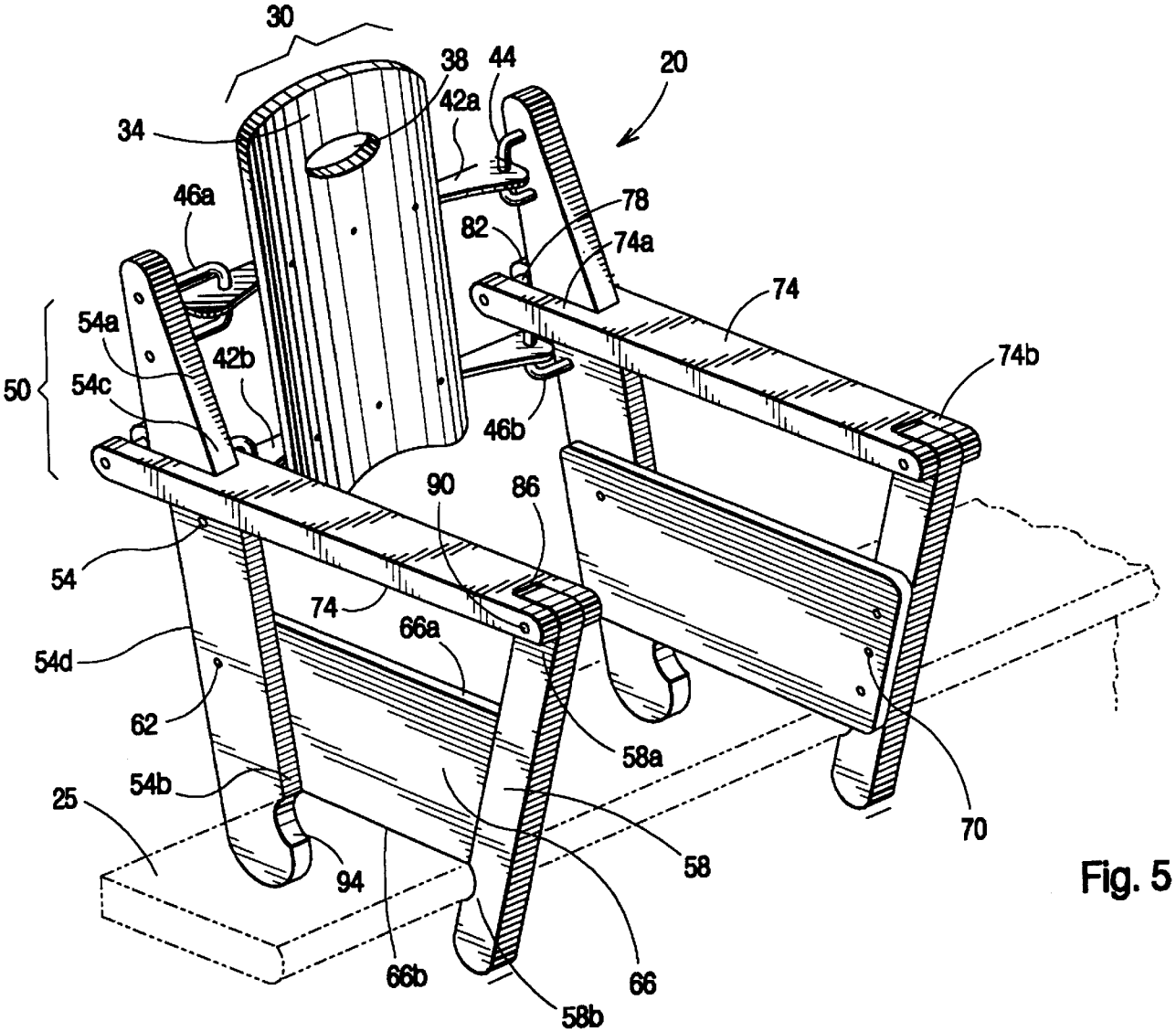
FIG. 5 is an isometric view of an alternative embodiment of the device of the invention shown in an operating, fastened position.

Both rear and front legs 54 and 58 respectively are preferably positioned at a slight angle from the vertical. This translates into a back receiving member or plate 34 with a slight reclining angle from the vertical for a person situated or reclining in the device of the invention. The present inventor has found that a substantially greater angle of incline results in a situation where the user may be uncomfortable, while a substantially negligible angle of incline, approximating along the vertical, causes the back receiving member or plate 34 to be too straight and therefore also uncomfortable during long periods of time. The angle of inclination is also reflected in the stability of the overall design. A greater angle of inclination will translate into a greater amount of force distributed along the transverse members of the device, which will in turn impart a greater amount of force upon the clevis pin 82. This relatively small angle between the vertical and the plane defined by the rear leg 54 and the back supporting member or plate 34 is also less intrusive to the people behind the person using the device of the invention, than if the angle of inclination were much greater. Furthermore, it is often the case that a spectator sitting upon a bench is not totally contained within the confines of the bench, and usually a person's posterior will be found to extend somewhat over the plane which is defined by the rear edge of such bench. Consequently, implementation or use of the device of the invention does not use or take up a substantially greater amount of space either behind, or to each side of, the device of the invention than its non use. The angle of inclination of the middle wedge section 54*c*, if it is too large, was found to be too "wedgy", and hindered the unclamping action when the user went to unfasten the device of the invention from a bench-type seat. A minimal middle wedge section 54*c* angle of inclination was found to be inefficient, and it did not translate into enough leg spread/compression distance during the fastening and unfastening modes. Consequently, the wedge angle should be appropriately dimensioned to provide optimum clamping and unclamping, with a proper amount of motion translation to accommodate the particular dimensions of the bench-type seat. For example, FIG. 5 shows a less preferred, continuous wedge angle extending continuously from the central wedge section 54*c* all the way up the biasing section 54*a*.

The longitudinal placement of the pivot connection 62 along the rear leg 54 is important to the stability of the device. The pivot connection 62 within the support plate 66 is preferably situated approximately two-thirds the distance down from the top of the rear leg 54, and consequently one-third the distance up from the bottom of the rear leg 54. If the pivot connection 62 is located just slightly above the curved bench edge engaging notch 94, then the force from the weight of a person reclining upon the back receiving member or plate may tend to shear the pivot connection 62 through the rear leg 54. If the pivot connection 62 is longitudinally located just slightly below the "U" hook connection 46*b*, and therefore just slightly below the arm receiving member 74 in its lowest position, i.e. when it's substantially horizontal, then the support plate 66 would be too massive for its purpose, and would add unnecessary weight to the device of the present invention 20.

FIG. 2 illustrates movement of the arm receiving member 74, the rear leg 54 and the support plate 66 in the direction of the arrows, from an open, unfastened position shown in phantom, to a fastened position shown in solid lines. Movement of the rear section 74*a* of the arm receiving member 74 along the upper section 54*a* of the rear leg 54 occurs between the first "U" bolt 46*a* when the rear section 74*a* is at its uppermost position along section 54*a*, and the second "U" bolt 46*b* when the rear section is at is lowest position and "wedged" along middle wedge section 54*c*. The apparatus is therefore in an "unfastened" state when the arm receiving member 74 is raised along the upper section 54*a*, which in turn, by contact with the clevis pin 82, pivots the rear leg 54 outward and away from the bench-type seat. The apparatus is in a "fastened" state when the arm receiving member is urged downward along the upper section 54*a* and upon the middle wedge section 54*c*, which in turn pivots the rear leg 54 inward toward the front leg 58 thereby causing the curved bench edge engaging surfaces 94 located on both legs 54 and 58 to constrictively "grasp" the edges of a bench 25 and fasten thereto. The arm receiving member 74 will preferably assume a substantially horizontal position when section 74*a* is at its lowest position along the middle wedge section 54*c*, i.e. when the apparatus of the invention is fastened to the bench, and this is proper since it would be uncomfortable for a user to rest his or her arms upon an arm support which is slanted or angled downwardly at more than a relatively small angle.

Critical to the understanding of the uniqueness of the apparatus of the present invention is the dual functionality embodied within the arm supports 50, i.e. both as an actual arm support structure and a means by which to fasten the apparatus of the invention 20 to the mere edges of a bench-type seat 25. Previous designs have by and large utilized hook-like members which have inherent spatial and compositional constraints. The present inventor's implementation of the fulcruming arm receiving member 74 in combination with the pivoting front leg 58 or rear leg 54, and the ability of the device of the invention to "grasp" the mere edges, or "bullnose", of a bench-type seat and anchor the apparatus of the invention 20 to the bench-type seat using these bench edge engaging members 97, transforms a simple arm support into a system which fastens to a bench-type seat like no device previously constructed. It is also desirable that the arm receiving member 74 assume a horizontal orientation when the device of the invention is fastened to a bench-type seat 25, since the weight of the user's arms and body helps maintain the arm receiving member 74 in such a horizontal position, and as such helps prevent the elevation of the rear section 74*a* of the arm receiving member 74 resulting in the loosening of the device of the invention 20 from the edges of a bench-type seat 25. This fastening arrangement also acts as a type of safety lock, which prevents a person from behind the device of the invention from dislodging the device of the invention from the bench-type seat.

Another unique feature of the device of the present invention 20 is its ability to receive a person's body weight and support it, while at the same time such person's body weight increases the fastening arrangement, or the "grasp," of the device of the present invention upon the surface to which it is affixed. It will be understood that when a person leans upon the back supporting member or plate 34 during normal operation of the device of the invention 20, and/or when such person places his/her arms upon the arm supports 50, and more particularly upon the arm receiving members 74, the rearward force upon the back supporting member or plate 34 and/or the downward force upon the arm receiving members 74, indicative of the natural seated position of such person within the device of the invention 20, aids in the fastenable gripping of the rear leg 54 upon the bench-type seat 25. Many devices shown in the prior art combat a person's body weight and must rely solely upon the construction of the device to maintain the device in a fastenable, operating condition. The device of the present invention, however, takes advantage of a person's natural body position and uses such person's body weight to assist in maintain a "grip" upon the bench-type seat.

FIGS. 1 and 2 illustrate that the fastening motion occurs through the pivotal relationship between the arm receiving member 74 and the rear leg 54. The front leg 58, because of its fixed angular relationship with the support plate 66, does not pivot or strictly speaking, even move in response to any movement of the arm receiving member 74, and is preferably the first member of the device of the invention 20 to contact the edge of a bench-type seat, and more particularly to contact the front edge of a bench-type seat to anchor the device of the invention 20 to the bench. If the rear leg 54 was, however, deemed to be the anchoring leg, then the force imparted onto the rear leg 54 by the relational movement of the arm receiving member 74 upon the rear leg 54 would translate across the arm receiving member 74 and urge the front leg 58 inward toward the rear leg 54 and thus the bench-type seat. The support plate 66, and more particularly the lower edge section 66b which contacts the actual seating or upper surface of a bench-type seat, maintains the apparatus of the invention in horizontal alignment with the surface of a bench-type seat. The lower edge of section 66*b* of the support plate 66 is thus disposed along the same general plane as the uppermost interior surface of the curved bench edge engaging members 94, such that placement of the device of the invention 20 onto a bench-type seat will result in the convenient horizontal alignment of the bench edge engaging members 94 with the edges of such bench-type seat. This alignment makes the fastening of the device of the invention, i.e. the lowering of the arm receiving member 74 resulting in the pivoting of the rear leg 54 inward toward the edge of a bench-type seat, easier to accomplish since the normal forces defined by the weight of the device are counteracted and supported by the surface of the bench-type seat on which it rests in both an unfastened and a fastened state. Consequently, the fastening action is defined by a mere compression of both the rear leg 54 and the front leg 58 around the edges of a bench-type seat.

Figure 3:
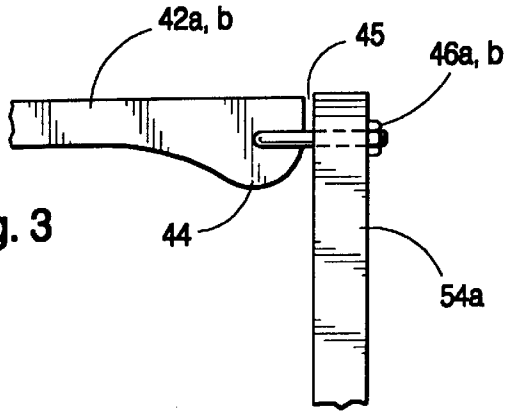
FIGS. 3 through 3C are top, diagrammatic views of a section of the device of the invention illustrating movement of the hinge connection of the invention between its unfastened and fastened states.
Figure 3A:
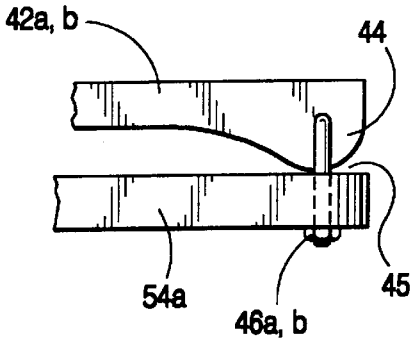

FIGS. 3, 3A, 3B and 3C represent top diagrammatic views of the use of the "U" shaped connecting members or of the "U" bolt 46*a,b* connection between the bracing members 42*a,b* and the upper biasing section 54*a* of the rear leg 54 of the arm support 50. The "U" bolt 46*a,b* engages each bracing member 42*a,b* through an orifice in the end of the bracing member 42*a,b* defined by a curved edge 44. FIG. 3 illustrates the arrangement of the invention 20 in an operating, fastened position, where the upper biasing portion 54*a* of the rear leg 54 of the arm support member 50 is situated or positioned angled away from the back rest member 30, while FIG. 3A illustrates the arrangement of the invention 20 in an unfastened, transporting position, where the upper biasing portion 54*a* of the rear leg 54 of the arm support member 50 is situated or positioned extending along the same general plane as the back rest member 30. The curved outer edge 44 of each bracing member 42*a,b* provides a clearance for rotation of the arm supports 50 about the bracing members 42*a,b,* from an orientation illustrated in FIG. 3 to an orientation illustrated in FIG. 3A. The geometry of the "U" bolt 46*a,b,* is such that the longitudinal space defined by the inside of the "U" is slightly longer than the distance between the connection of the "U" bolt 46*a,b* with the front edge of the bracing member 42*a,b* and the rear surface of the upper slanted section 54*a* of the rear leg 54 of the arm support 50. This small gap 45 provides the necessary clearance for rotation of the arm support 50 around the curved outer edge 44 of the bracing members 42*a,b*. The curvature of the curved outer edge 44 is such that the rotation of the arm support 50 away from the back rest 30 into an operating position is restricted to a position or orientation that is substantially perpendicular to the general plane of the back rest member 30. In other words, the arm supports 50 may not rotate past what is necessary to place the apparatus of the invention onto the surface of a bench-type seat. However, one arm support 50 may rotate inward toward the back rest 30 until it contacts the back rest 30, while the other arm support 50 may also rotate inward toward the back rest 30 following the other arm support 50 until it contacts the other arm support 50 which has already been rotated inward and has come to rest along the same general plane as that of the back rest 30.

Figure 3B:
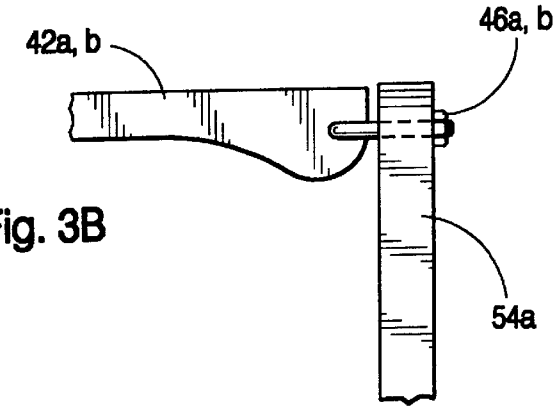
Figure 3C:
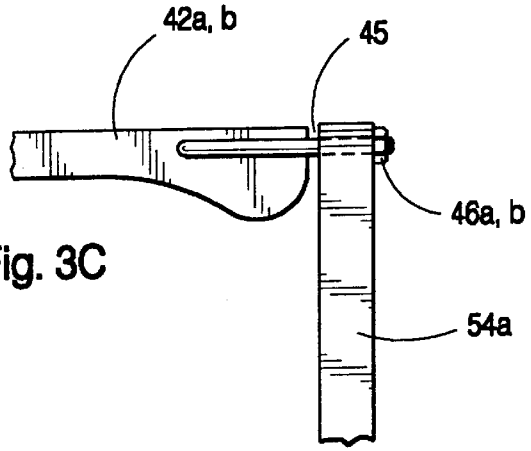

FIGS. 3B and 3C illustrate the difference in size between the shorter and longer pairs of "U"-bolts 46*a,b,* the longer pair being situated indiscriminately on either side of the device of the invention. As will be more fully described in connection with FIG. 4, the longer pair of "U"-bolts allows the arm supports 50 to rotate inward toward the back support 30 and form a parallel relationship with respect to each other as well as with the back support 30. FIG. 3C illustrates the longer "U"-bolt's further longitudinal extension into the bracing member or rib 42*a,b,* as opposed to the shorter "U"-bolt's minimal longitudinal extension into the bracing member or rib 42*a,b* illustrated in FIG. 3B. The gap between the bracing member or rib 42*a,b* and the upper slanted section 54*a* of the rear leg 54 remains constant with both shorter and longer "U"-bolt connections, as illustrated in FIGS. 3B and 3C, and therefore the length of the "U"bolt only impacts upon the device of the invention 20 in the folded, transportable position, and not necessarily in the open, operable position. When each arm support 50 is fully extended away from the back support 30 and is in an operable position, i.e. fastened to a bench-type seat, the difference in "U"-bolt size becomes noticeable only from the front, since the longitudinal position of the "U"-bolt along the bracing member or rib 42*a,b* can be viewed from the front of the device of the invention. When the arm supports 50 are folded inward toward the back support 30, the difference in "U"-bolt lengths will be apparent when viewing the device from the side.

This unique "U"-bolt rotating arrangement is superior to what previous inventors have used to effect the change in position of their side support panels. Previous devices disclose either a creased, or ribbed, connection between the back rest member and the side support panels, which "flex"es in response to the folding and unfolding of the side panels. The "U"-bolt arrangement of the present invention allows for continuous and repetitive rotations of the arm supports 50 about the bracing members or ribs 42*a,b* without any mechanical fatigue resulting from the repetitive rotations. It is preferable to have a reinforced orifice where the top of the "U" bolt 46*a,b* extends through the bracing member or rib 42*a,b,* since while the rotation of the "U"-bolts around such connection or orifice is the only physical movable contact between the arm supports 50 and the bracing members or ribs 42*a,b,* if the backrest or seating device of the invention is used frequently enough, some wear may occur in the orifice in the braces or ribs 42*a* and 42*b* through which the "U"-bolts pass.

Figure 4:
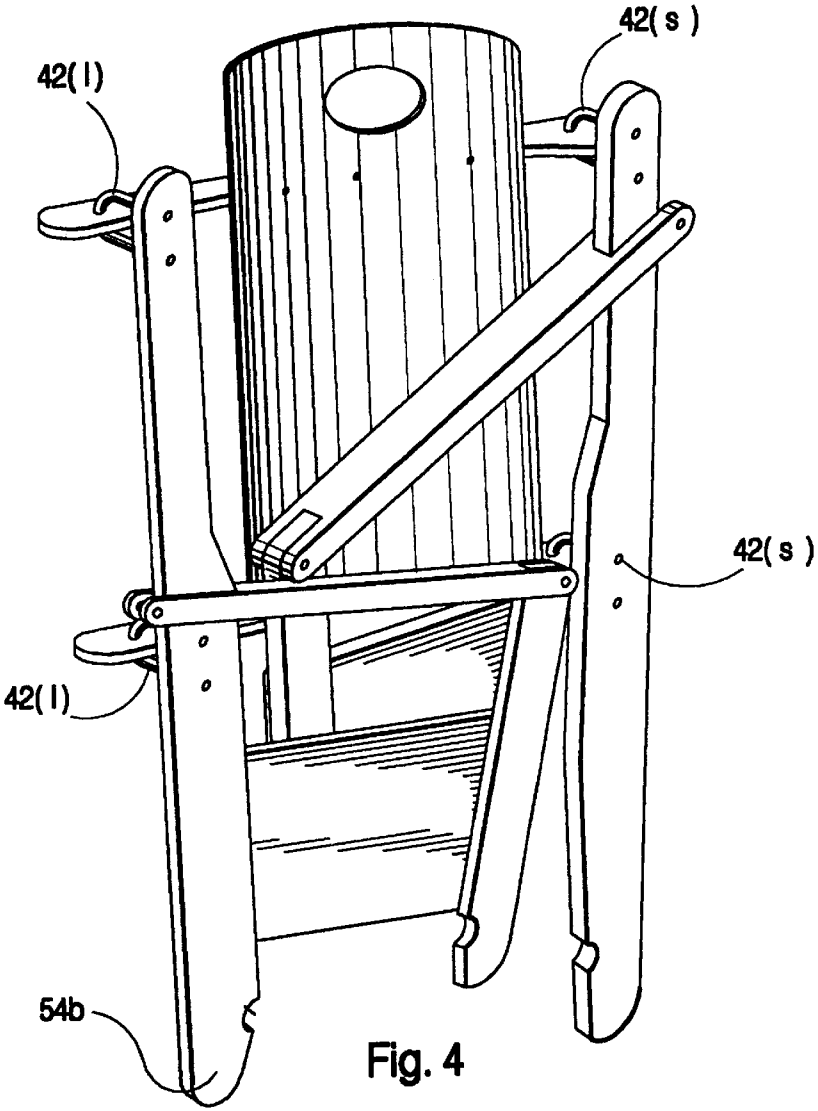
FIG. 4 is an isometric view of the device of the invention in its folded, transportable position.

FIG. 4 is a diagrammatic, front isometric view of the device of the invention 20 in its closed, transportable position, with the arm supports 50 folded inward toward the back support 30. For purposes of this figure, the left arm support 50, or the arm support which is closest to the back support 30 in the folded position, contains the shorter "U"-bolts 42*a,b*(s), while the right arm support 50, or the arm support which is folded over the left arm support 50 and farthest away from the back support 30, contains the longer "U"-bolts 42*a,b*(l). Also for purposes of this figure, the innermost arm support 50 in the folded position is designated the "inner" arm support, while the outermost arm support 50 in the folded position is designated the "outer" arm support. In the folded, transportable position, the left arm receiving member 74 is actually resting upon the right arm receiving member 74, and this is achieved through the appropriate positioning of the arm receiving members 74 along the rear legs 54. The arm receiving member 74 of the outer arm support 50 is lowered to its operating, or fastening position, while the arm receiving member 74 of the inner arm support 50 is raised to its transportable, or releasing position. The positioning of the arm receiving members 74 in this fashion will allow the inner arm support's arm receiving member to rest upon the outer arm support's arm receiving member. The resultant configuration thereby becomes "tightly" transportable, and the interlocking effect between the arm receiving members of the two arm supports maintains the arm supports in their foldable, transportable position without the need for external support keeping the arm supports folded inward to the back support during transport. Alternatively, the arm support members 50 can be secured in a folded position by external tying means of any suitable type. The lower section 54*b* of the rear leg 54 is shown in FIG. 4 elongated by approximately one inch, so that the device of the invention, in the folded, transportable position, rests both lower rear leg sections 54*b* efficiently upon a planar surface (ground). The additional length of the lower section 54*b* does not impact on the stability or the effectiveness of the device of the invention during its operation, since the extended length extends down alongside any closure structure below the seats, however it does provide for easy and convenient stacking, especially during transport and for commercial display. If the lower section of the rear leg 54*b* were the same length as the lower section of the front leg 58*b,* the device of the invention would tend to "teeter" or "rock" between the front and rear legs, 58 and 54 respectively, when placed on a planar surface in the folded, transportable position. On the other hand, it may be preferable, in some instances, to have all the legs the same length for uniformity and balance in the appearance.

Operation of the device of the invention is fairly straightforward. It is gripped by a person using the cut-out section 38 as a handle, and is transported to a bench-type seat in its folded position, illustrated and described in connection with FIG. 4. The device of the invention is then "unfolded" so that each arm support 50 is situated somewhat perpendicular to the back support 30. Each arm receiving member 74 is then moved or pulled so that the rear section 74*a* is raised along the upper section 54*a* of the rear leg 54, resulting in the maximum displacement, or separation, between the rear leg 54 and the outer leg 58. Thus, the device of the invention 20 is initially placed in its unfastened, or released position. Holding the device by both arm receiving members 74 in their raised positions or displaced to open orientation, while positioned in front of the bench-type seat, the device is then placed onto the top of a bench-type seat by first preferably placing the curved bench edge engaging members 94 of the front legs 58 in contact with the front edge, or "bullnose" of the bench-type seat, then rotating the device of the invention rearward so that the rear legs 54 extend behind the rear edges of the bench-type seat, and the lower edge 66*b* of the support plate 66 is in contact with the top surface of the bench type seat. Thus, the front leg serves to anchor the device of the invention as it is first placed onto a bench-type seat. The device of the invention is then fastened onto the seat by pushing the arm receiving members 74 downward along the upper section 54*a* of the rear leg 54 so that the arm receiving member wedges, or fastens, onto the middle wedge section 54*c* of the rear leg 54, which pivots the rear leg 54 inward toward the rear edge of the bench-type seat so that the curved bench edge engaging members 94 of the rear leg 54 come in contact with and grasp the rear edge, or "bullnose," of the bench-type seat. The fastening motion accomplished by the downward urging of the arm receiving members 74 acts to, in essence, cause the front and rear legs to compress about the edges of the bench-type seat, thereby allowing the device of the invention to "grasp" the mere edges of a bench-type seat. The user would then sit down on the bench-type seat, lean back ever so slightly so that the user's back comes in contact with the back receiving member or plate 34, and place his or her arms onto the arm receiving members 74 of the arm supports 50, which are now situated in a substantially horizontal, fastened position. Shifting movement, either in the longitudinal or transverse directions, will not affect the fastened connection between the device of the invention and the bench-type seat, and the placement of the user's arms upon the arm supports will add further fastening force to the notches 94 upon the edges of the bench-type seat 25, since the weight imparted by the arms of the user will tend to keep the arm receiving members in the horizontal, fastened position. To release the device of the invention from a bench-type seat, the user merely has to lift the arm receiving members 74 upward so that the curved bench edge engaging sections 94 of the rear leg are released from the rear edge of the bench-type seat, and then the entire device of the invention is rotated toward the user, all the time anchored or pivoting upon the curved bench edge engaging sections 94 of the front leg 58, until the rear legs 54 of the device of the invention have cleared the rear edge of the bench-type seat, and the device of the invention is lifted off the bench-type seat so that the curved bench edge engaging sections 94 of the front legs 58 are no longer in contact with the front edge of the bench-type seat. The arm supports 50 are then folded inward to assume a transportable configuration of the device as a whole. The arm support 50 with the shorter "U"-bolts 42*a,b*(s) is rotated inward toward the back support 30, followed by the rotation of the arm support 50 with the longer "U"-bolts 42*a,b*(l) inward toward the back support 30 and the previously rotated arm support 50. The arm receiving member 74 from the outer arm support 50, i.e. from the arm support 50 with the longer "U"-bolts 42*a,b*(l), is then urged downward so that the front section 74*b* of the arm receiving member 74 of the inner arm support 50 is resting upon the arm receiving member 74 of the outer arm support 50, as shown in FIG. 4. The junction between the two arm receiving members 74 in the folded positions as shown in FIG. 4 is slightly compressive, so the arm receiving members will remain in contact with one another even if the device of the invention is moved around as though it were being transported. In order to release this connection, a user would have to vigorously shake the device of the invention, which would result in the separation of the arm receiving members 74. This slight compressive feature results in an arrangement which requires no external support structure, such as a cord or a rope, which needs to be used to maintain the arm supports 50 in their folded positions. The device of the invention may then be stored either on a hook using the cut-out portion 38, or it may rest upon a flat surface due to the elongated lower sections 54*b* of the rear legs 54.

FIG. 5 is an isometric view of a less preferred form of the invention, in which the wedging portion 54*c* of the rear legs 54 of the device of the invention 20 extends from the central portion of the device 54*c* all the way to the top of the leg portions 54. This arrangement, while suitably operable, is not as desirable as the arrangement shown in the previous figures, because the locking to the bench-type seat 25 is not as certain in the critical range of movement. There is, however, somewhat more flexibility with respect to adjustment to accommodate slightly varying bench widths.

Normally the back and arm support device of the invention 20 will be used in conjunction with a separate cushion on the bench-type seat within the space enclosed by the arm supports 50 and the back rest 30. However, a special cushion may be permanently attached to either one of the arm supports 50 or the back rest 30 on a folding securing means of any suitable nature. A padded cushion attached to the back receiving member or plate 34 can also have a folded down section which will fit on the bench-type seat under a user of the device of the invention. Either of such attached cushions will be folded up behind the folded arm supports when the device of the invention rest is not in use. A compartment for storage of stadium-type equipment, such as a blanket, Thermos®-type bottle and the like, can also be attached to the rear of the backrest 30, particularly, but not necessarily, between the ribs or bracing members 42*a* and 42*b*.

Since stadium bench-type seats are usually fairly uniform in width, the width depending basically upon the most readily obtained width of boards or lumber used to produce the bench-type seat, it is usually not commercially or practically worthwhile to make the device of the invention widely adjustable to varying width benches. However, where adjustability may be desirable, it may be obtained by providing a series of pivot orifices, horizontally displaced from each other, to define the pivot connection 62, possibly accompanied by the widening of the leg 54 at this point to accommodate such pivot orifices, plus preferably the use of a reinforcing plate also at this point. However, only approximately plus or minus one inch at most of adjustment can be obtained in this manner. To obtain additional adjustment, it is necessary to provide means for varying the relative sizes of the various parts of the device of the invention. One of the simplest ways to provide such an adjustable structure is to combine the multiple pivot positions described above with lengthening of the slot 78 and providing an adjustable pin at the inner end of such slot 78 against where the angled or wedge portion 54*c* of the leg 54 will bear. At the same time the clevis pin 82 at the end of such slot will be made longitudinally adjustable along the slotted length.

This, in effect, makes the length of the arm receiving member 74 adjustable to match the position of the non-adjustable pivot connection 62, and adapts the device of the invention for adjustable use on other more widely-varying widths of bench-type seats. Other means for adjustment will occur to those skilled in the art. One disadvantage of the lengthening of the slot 78 is that when the position of the clevis pin 82 is adjusted for a very narrow bench, the rear end of the arm receiving member 74 may extend to the rear of the device of the invention as a whole possibly interfering with clearance in the aisle in the bleachers behind the back receiving member or back support plate 34. This disadvantage could be remedied, however, by making the length of the arm receiving member 74 adjustable in the center by some suitable telescoping arrangement.

The device of the invention is particularly adaptable for manufacture from wood, providing a rustic quality or appearance when so made. However, it can equally well be constructed from a strong durab le plastic composition of various colors, or even of light metal such as aluminum or aluminum alloy. While sturdily made, the construction of the seating device is such that it is not unduly heavy and can be readily carried, or "toted," by even children and the more elderly. The device is not only easily carried or transported to its place of use, but is also compactly folded so that it can be easily stored on the floor of a closet, or on a hook in a closet, or in another storage location. The construction of the clamping arrangement, using the arm rest as the leveraging arm, is such that the back rest not only is securely clamped to stadium-type benches, but feels as secure to the user as it actually is. Furthermore, the user can monitor its actual security at all times by noting the angle of the arm rests, either visually or by feel, and can easily check its security by attending to such angle periodically during a sporting event and tending to provide to the user a psychological feeling of being in control of their own security.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A portable back and arm rest for use upon a bench seat comprising:

a. a back support member foldably attached to a pair of arm supports, b. the arm supports each in part comprising a pair of elongated members pivotally mounted to a support plate so that respective lower ends of said elongated members approach and recede from each other, c. the arm supports each further comprising an arm receiving member pivoted at one end to an upper portion of one of said pair of the pivotally mounted, elongated members, and slidably receiving an inclined section of an upper portion of the other elongated member, such that when the arm receiving member is forced down upon said inclined section, the lower ends of said pair of pivotally mounted members approach each other to a predetermined distance equivalent to the width of a bench seat to lock or clamp onto such a said seat.

2. A portable back and arm rest in accordance with claim 1 wherein the orientation of the arm rest member is substantially horizontal where the lower ends of the pivoted members are brought to their closest spacing.

3. A portable back and arm rest in accordance with claim 2 wherein the inclined section on each one of the other pivotally mounted elongated members is positioned in a central location of said other elongated member.

4. A portable back and arm rest in accordance with claim 3 wherein the back support is pivoted at both sides to the arm support members by "U"-shape securing members of unequal length, such that the arm support member pivoted on the shorter "U"-shaped securing members may be folded substantially parallel to the back rest member, and the other arm support member pivoted on the longer "U"-shaped securing members may be folded over the arm support member of the shorter "U"-shaped securing members substantially parallel to the arm support member of the shorter "U"-shaped securing members.

5. A portable back and arm rest in accordance with claim 4 wherein the bottoms of the pivoted elongated members are notched on their inner sides to receive the edges of said bench seat in a clamping position.

6. A portable back and arm rest in accordance with claim 5 wherein said support plate is fixedly fastened to one elongated member and pivotally connected to the other elongated member, the elongated member to which the support plate is fixedly connected being the same member to which the arm receiving member is pivoted at a more elevated position.

7. A portable back and arm support device for placement on a bench seat comprising:

a. a back receiving member, b. a plurality of transversely extending bracing members, with curved outer ends, the bracing members connected by fasteners to the rear of the back receiving member, c. a pair of arm supports hingedly connected to the ends of the bracing members, each arm support being comprised of a rear leg, a front leg, an arm receiving member with a front section pivotally connected to said front leg and a rear section slidable on said rear leg, and a support plate interconnecting the front leg and the rear leg, and d. a fastening means arrangement incorporated within each arm support which draws a portion of the rear leg toward a portion of the front leg and thereby fastens or clamps the device to the bench seat.

8. A portable back and arm support device for placement on a bench seat in accordance with claim 7 wherein the hinged connection further comprises "U"-shaped bolts, where the clearance defined by the "U" shape allows each arm support to rotate from a folded, transportable position to an open, fastening position.

9. A portable back and arm support device for placement on a bench seat in accordance with claim 8 wherein the "U"-shaped bolts which connect one arm support to the bracing members of the back support are longer than the "U"-shaped bolts which connect the other arm support to the bracing-members of the back support, allowing the arm support connected with the longer "U"-shaped bolts to fold in a parallel arrangement to the already folded arm support connected to the back support using the shorter "U"-shaped bolts.

10. A portable back and arm support device for placement on a bench seat in accordance with claim 9 wherein each leg further contains bench edge engaging members dimensioned to receive edges of the bench seat and facilitate the gripping of the edges as the portable back and arm support device is fastened to the bench seat.

11. A portable back and arm support device for placement on a bench seat in accordance with claim 10 wherein the fastening means incorporated within each arm support further comprises means for facilitating sliding the rear section of the arm receiving member along the rear leg from an uppermost, releasing position where said portion of the rear leg is pivoted to a position farthest from said portion of the front leg, to a substantially horizontal, fastening position where said portion of the rear leg is pivoted to a position closest to said portion of the front leg, such pivoting movement of the rear leg being inward acting to fasten or clamp the portable back and arm support device to the bench seat.

12. A portable back and arm support device for placement on a bench seat in accordance with claim 4 further comprising improved fastening means defined by a rear leg incorporating a wedge construction upon which the arm receiving member rests in its substantially horizontal, fastening position.

* * * * *